US005946760A

United States Patent [19]

Eames, Jr.

[11] Patent Number: 5,946,760

[45] Date of Patent: Sep. 7, 1999

[54] APPLICATOR HEAD

[75] Inventor: Stuart P. Eames, Jr., Hertford, United Kingdom

[73] Assignee: Farecla Products Limited, Hertfordshire, United Kingdom

[21] Appl. No.: 08/913,198

[22] PCT Filed: Mar. 1, 1996

[86] PCT No.: PCT/GB96/00482

§ 371 Date: Dec. 4, 1997

§ 102(e) Date: Dec. 4, 1997

[87] PCT Pub. No.: WO96/27480

PCT Pub. Date: Sep. 12, 1996

[30] Foreign Application Priority Data

Mar. 3, 1995 [GB] United Kingdom ..... 9504317

[51] Int. Cl.[6] ..... B24D 13/14; B24D 13/20

[52] U.S. Cl. ..... 15/230; 15/97.1

[58] Field of Search ..... 15/97.1, 230, 230.17, 15/230.19; 451/353, 359

[56] References Cited

U.S. PATENT DOCUMENTS

| | | | |
|---|---|---|---|
| 3,346,904 | 10/1967 | Armstrong | 15/230.19 |
| 4,692,958 | 9/1987 | McMakin | 15/230.17 |
| 4,907,313 | 3/1990 | Roeker et al. . | |
| 5,003,659 | 4/1991 | Paepke | 15/230.17 |
| 5,123,139 | 6/1992 | Leppert et al. . | |
| 5,150,546 | 9/1992 | Tucker . | |
| 5,461,750 | 10/1995 | Kaiser | 15/230 |

FOREIGN PATENT DOCUMENTS

| | | |
|---|---|---|
| 0459699 | 12/1991 | European Pat. Off. . |
| 559372 | 8/1943 | United Kingdom . |
| 875566 | 8/1961 | United Kingdom . |

*Primary Examiner*—Terrence R. Till

*Attorney, Agent, or Firm*—McAndrews, Held & Malloy, Ltd.

[57] ABSTRACT

An applicator head comprises a pad and a hub element. The hub element has on one side a boss for coupling to a rotary drive unit and on the opposite side a surface releasably attached to the pad. The pad has a central axis and a recess centered about the axis and complementary with the attachment surface of the hub element such that the attachment surface engages the base of the recess, and the pad and the boss are in substantially coaxial alignment. The releasable attachment is preferably provided by a hook-and-loop type fastener.

6 Claims, 2 Drawing Sheets

APPLICATOR HEAD

FIELD OF THE INVENTION

This invention relates to an applicator head for attachment to a rotary drive unit. Such heads are used to finish surfaces and are commonly utilised in the motor trade.

BACKGROUND OF THE INVENTION

Applicator heads are used in conjunction with various compounds to treat the surfaces of a wide range of materials including paint, metal composites and plastics. The compound is normally in the form of a paste or liquid. The heads typically consist of a cylindrical pad with a hub element fixed to one end face for attaching the pad to the shaft of a drive unit. The pad material is selected according to the material to be treated or the particular stage of a series of treatments to the same surface.

In one known applicator head configuration, the pad is permanently fixed to the hub element and it is necessary to replace the complete head once the pad is worn out. Another form of head incorporates a replaceable pad arrangement, in which a "hook-and-loop" type fastening system is used with components disposed on opposing planar faces of the pad and the hub element. Thus, once the pad had exceeded its useful life, it alone needs to be replaced, without also requiring a new hub element. However, with this arrangement it is difficult to ensure that the hub element is fixed coaxially against the pad, with any eccentricity leading to increased vibration and wear.

SUMMARY OF THE INVENTION

The present invention provides an applicator head comprising a pad and a hub element, which element has on one side a boss for coupling to a rotary drive unit and on the opposite side a surface releasably attached to the pad, and the pad has a central axis and a recess centred about said axis and complementary with the attachment surface of the hub element such that the attachment surface engages the base of the recess and the pad and the boss are in substantially coaxial alignment.

The releasable attachment may be provided by a hook-and-loop fastener, with the hooks on the attachment surface of the hub element and the loops on the recess. Preferably, the boss is integrally formed with the portion of the hub element providing the attachment surface. The pad may be substantially in the form of a solid cylinder, with the recess formed in an end face thereof. In one preferred arrangement the attachment surface and the base of the recess are substantially planar. Alternatively, the base of the recess may be substantially conical, with its vertex lying on the central axis of the pad.

An applicator head according to the invention provides for easy replacement of the pad itself, without the simultaneous need for a new hub element, but with minimal risk of it being eccentrically mounted on the hub element. The central and recessed location of the hub element also permits the pad to distort around it in use, with little risk of the hub element engaging the surface being treated and consequent damage thereto.

BRIEF DESCRIPTION OF THE DRAWINGS

A known arrangement and an embodiment of the invention will now be described by way of example and with reference to the accompanying schematic drawings wherein.

DETAILED DESCRIPTION OF THE PREFERRED EMBEDMENT(S)

Figure 1:
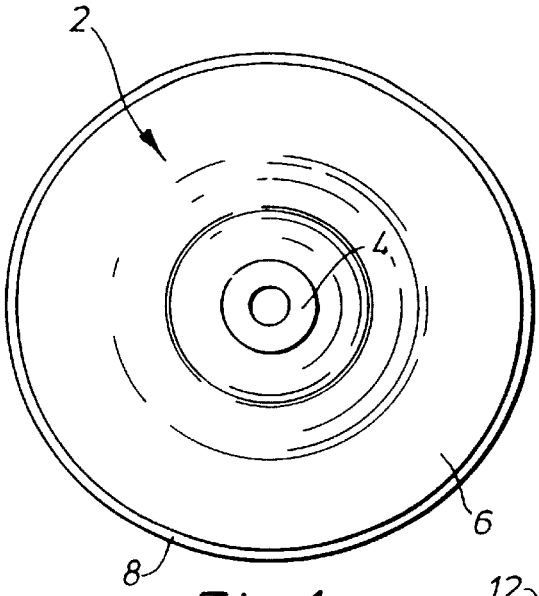
PRIOR ART Fig.1.
FIG. 1 is a plan view of a known applicator head.
Figure 2:
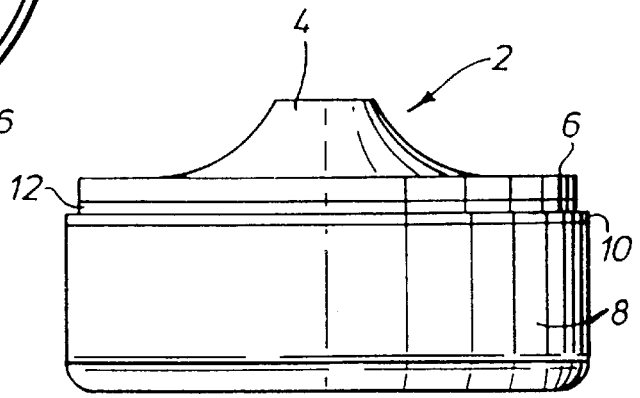
Fig.2. PRIOR ART
FIG. 2 is a side view of the applicator head of FIG. 1.

In the known applicator head configuration of FIGS. 1 and 2, a hub element 2 consists of a boss 4 and a circular plate 6. The boss is provided centrally on the plate and is adapted to fasten to the end of a drive shaft, by means of a screw thread for example. A head of this type is typically for use with a hand-held polishing machine. A substantially cylindrical pad 8 is mounted against the surface of the plate opposite the boss 4. The pad may be formed from natural or synthetic material, or a mix thereof, depending on its particular application. The pad 8 and hub element 2 are releasably attached together, using a "hook-and-loop" fastener, of the type sold under the registered trade mark VELCRO. Therefore it is only necessary to replace the pad itself once it is worn out, thus conserving materials and reducing the cost of renewing the head. Normally, a layer of loops 10 and a layer of hooks 12 are provided on the end face of the pad 8 and the opposing face of the plate 6, respectively, and not vice versa, as the loops are more susceptible to damage and can therefore be discarded with a worn pad.

The circular plate 6 in this arrangement covers substantially the whole of the end face of the pad 8. This maximises the surface area of attachment, thereby enhancing the securement of the pad to the plate. However, the edge of the plate may occasionally contact the surface being treated, causing damage thereto. Another problem is that the plate cannot be accurately positioned in axial alignment with a new pad. This results in increased vibration, wear and operator fatigue during use.

Figure 3:
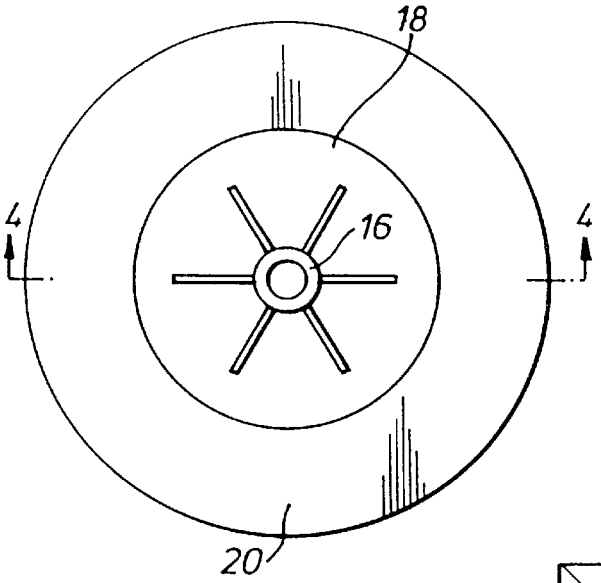
FIG. 3 is a plan view of an applicator head in accordance with the invention.
Figure 4:
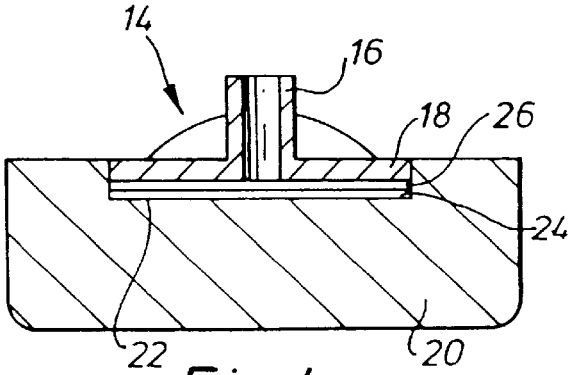
FIG. 4 is a cross-sectional view of the applicator head of FIG. 3 along line A—A.
Figure 5:
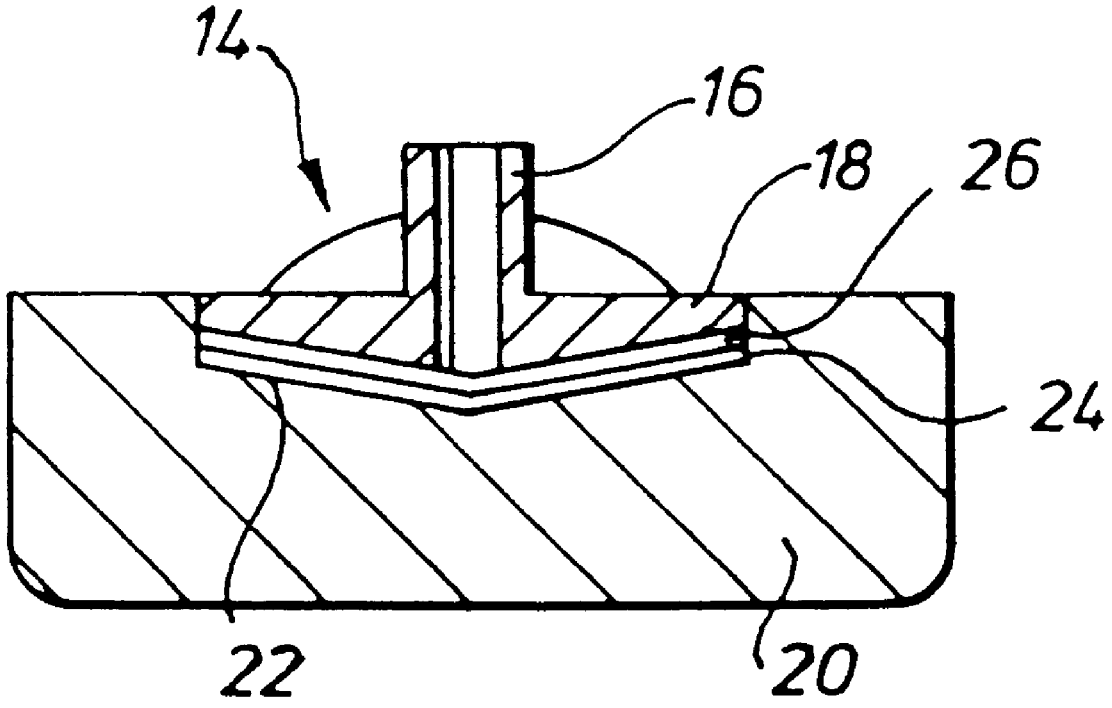
FIG. 5 is a cross-sectional view of the applicator head of FIG. 3 along line A—A, which generally corresponds to the applicator head of FIG. 4, but also shows the substantially conical recess and the central axis on which its vertex lies.

An applicator head of the invention is illustrated in FIGS. 3–5. It comprises a hub element 14 having a boss 16 which is integrally formed with a circular plate 18, and a substantially cylindrical pad 20. Different pad shapes may be appropriate for different purposes.

The circular plate 18 fits into a complementary recess 22 formed on one end face of the pad 20. Other configurations of the complementary surfaces may be adopted to provide different forms of engagement. For example, the provision of a shallow conical surface on the base of the recess may be beneficial as shown in FIG. 5. In another alternative, undulations may be formed therein.

A releasable fastener is used to hold the circular plate 18 against the base of the recess 22, and is preferably of the "hook-and-loop" type. A layer of loops 24 is provided on the pad 20, with a layer of hooks 26 on the opposing surface of the hub element 14.

The hub element is preferably formed by an injection moulding process, a suitable plastic being one of the ABS group of copolymers. As noted above, the pad material is selected according to the particular treatment to be carried out. For example, for finishing painted surfaces, a high density non-absorbent foam is appropriate, which may be formed of polyester. The layers of loops and hooks are preferably fastened to the respective components of the applicator head using a solvent-borne polyurethane-based adhesive, although it will be appreciated any means for providing the requisite bond can be used.

As the plate shown in FIGS. 3–5 has a diameter significantly smaller than that of the pad, and is fitted in the recess 22, there is no risk of it contacting the surface being treated during use. The recess also serves to locate the plate substantially coaxially with respect to the pad. Thus a pad can readily be replaced in the appropriate position.

What is claimed is:

1. An applicator head comprising a pad and a hub element, which hub element has on one side a boss for coupling to a rotary drive unit and on the opposite side a surface releasably attached to the pad, and the pad has a central axis and a recess centered about said axis, said recess having a base, and complementary with the attachment surface of the hub element such that the attachment surface engages the base of the recess and the pad and the boss are in substantially coaxial alignment, and wherein the pad is substantially in the form of a solid cylinder with the recess formed in an end face thereof, and wherein said pad includes a releasable attachment directly contacting the solid cylinder.

2. An applicator head according to claim 1 wherein said releasable attachment is provided by a hook-and-loop fastener, with the hooks on the attachment surface of the hub element and the loops on the recess.

3. An applicator head according to claim 2 wherein the boss is integrally formed with the portion of the hub element providing the attachment surface.

4. An applicator head according to claim 1 wherein the attachment surface and the base of the recess are substantially planar.

5. An applicator head according to claim 1 wherein the base of the recess is substantially conical, with its vertex lying on the central axis of the pad.

6. An applicator head according to claim 1 wherein the boss is integrally formed with the portion of the hub element providing the attachment surface.

* * * * *